US005228419A

United States Patent [19]

Nonogawa

[11] Patent Number: 5,228,419

[45] Date of Patent: Jul. 20, 1993

[54] VALVE OPERATING SYSTEM FOR ENGINE

[75] Inventor: Kenichi Nonogawa, Iwata, Japan

[73] Assignee: Yamaha Hatsudoki Kabushiki Kaisha, Iwata, Japan

[21] Appl. No.: 619,895

[22] Filed: Nov. 28, 1990

[30] Foreign Application Priority Data

Nov. 29, 1989 [JP] Japan ..... 1-309471
Nov. 29, 1989 [JP] Japan ..... 1-309472

[51] Int. Cl.[5] ..... F01L 1/26

[52] U.S. Cl. ..... 123/90.27; 123/90.22

[58] Field of Search ..... 123/90.22, 90.27, 90.39, 123/90.4, 90.41, 90.44

[56] References Cited

U.S. PATENT DOCUMENTS 4,494,489 1/1985 Seidl ..... 123/90.27
4,660,529 4/1987 Yoshikawa ..... 123/90.27
4,662,323 5/1987 Moriya ..... 123/90.27
4,819,591 4/1989 Valentine ..... 123/90.27
4,979,474 12/1990 Morishita ..... 123/90.27
5,060,605 10/1991 Yamazaki ..... 123/90.27
5,070,824 12/1991 Morishita ..... 123/90.27
5,125,374 6/1992 Saito ..... 123/90.22

*Primary Examiner*—E. Rollins Cross
*Assistant Examiner*—Weilun Lo
*Attorney, Agent, or Firm*—Ernest A. Beutler

[57] ABSTRACT

A rocker arm and valve arrangement for a multiple valve internal combustion engine that permits a low engine height even though two of the valves reciprocate along axes that are not parallel to each other. However, the configuration is such that the loading on the valve actuating mechanism and specifically the followers and tips of the valves is minimize and so that wear on the tips of the valves is equalized.

31 Claims, 7 Drawing Sheets

VALVE OPERATING SYSTEM FOR ENGINE

BACKGROUND OF THE INVENTION

This invention relates to a valve operating system for an engine and more particularly to an improved system for operating a multiple valve system of an internal combustion engine from a single camshaft.

It has been acknowledged that the performance of an internal combustion engine can be improved through the use of multiple intake and exhaust valves. It is a widely common practice to employ four valves per cylinder in connection with high performance engines. Further performance improvements can, however, be achieved if five valves (three intake and two exhaust) are employed for each combustion chamber of the engine. However, when using more than four valves per cylinder, certain problems arise.

In order to achieve a good combustion chamber configuration i.e. a small surface area and small clearance volume, it is necessary to carefully position the valves. This has been achieved by positioning two of the intake valves to reciprocate about respective parallel axes that lie at an acute angle to a plane containing the cylinder bore axis, these valves being the side intake valves. In addition, a center intake valve is also supported for reciprocation about an axis that lies in a plane that is substantially parallel to the planes of reciprocation of the side intake valves but which is disposed at a lesser acute angle to the plane containing the cylinder bore axis. As a result of this configuration, the tip of the center intake valve has extended a greater distance upwardly from the lower surface of the cylinder head than those of the side intake valves. When all valves are operated by rocker arms from a single overhead camshaft, this means that the height of the engine can be substantially increased. The reason for this is that the rocker arm and its adjusting screw adds considerably to the height of the cylinder head and, accordingly the total height of the engine.

In connection with the placement of the rocker arm and its follower which engages the tip of the valve, it has been the normal practice to position the rocker arm and valve reciprocation axes in such a manner that a line drawn between the point of contact of the follower with the tip of the valve and the rocker arm pivot axis and the axis of reciprocation of the valve is at an acute angle when the valve is closed and is at an obtuse angle when the valve is open and is at a right angle when the valve is halfway between its closed and opened positions. This is done so as to reduce stress and wear between the follower and the tip of the valve. However, this type of relationship gives rise to the added height of the engine, as aforenoted.

If the height of the tip of the center intake valve above the cylinder head sealing surface is reduced, than the angular relationship aforenoted can become disadvantageous and give rise to added stress on the valve actuating components. That is, if the height is reduced, the angular relationship aforedescribed may start out at a right angle and then progress to an obtuse angle thus substantially increasing the wear and stress on the components.

It is, therefore, a principal object of this invention to provide an improved valve actuating system for a multivalve engine which permits optimum valve placement and reduces stress on the valve actuation and wear on the valve actuating components.

It is a further objection of this invention to provide a valve and operating system for an overhead valve and internal combustion engine that permits a compact engine construction and which reduces wear and stress on the valves.

In addition to the angular relationship aforedescribed, the follower which engages the tip of the valve also rolls across an arc on the tip of the valve as the valve is moved between its closed and opened positions. This is because the rocker arm and follower operate about a pivotal axis while the valve operates about a reciprocatory axis. When the tip of the valves is lowered, then the wear pattern on the tips and caused by contact with the followers can move to an off center relationship thus further aggravating wear.

It is, therefore, a still further object to this invention to provide and improved arrangement for permitting a reduction in the height of a single overhead cam multiple valve engine without creating undo wear patterns on the follower and valve tip.

SUMMARY OF THE INVENTION

The invention is adapted to be embodied in a valve system for a multiple valve internal combustion engine comprising a cylinder head assembly supporting first and second poppet valves for reciprocation between closed and opened positions about respective first and second reciprocal axes inclined at different acute angles to a plane containing the axis of the associated cylinder. The acute angle of reciprocation of the first poppet valve is less than the acute angle of reciprocation of the second poppet valve. Rocker arm means is provided for operating the valves and the rocker arm means is pivotal about a rocker arm axis that extends parallel to the aforementioned plane. The rocker arm means has respective first and second follower portions engaged with the tips of the stems of the first and second valve respectively. The tips of the valves lies substantially in a common plane with the rocker arm axis when the valves are in their closed positions.

In accordance with a first feature of the invention, the angle between a line passing between the point of contact of the first follower with the tip of the first valve and the rocker arm axis and the first reciprocal axis passes from an acute angle when the first valve is in its closed position to a right angle before the first valve is one half open and to an obtuse angle when the first valve is in its fully opened position.

In accordance with another feature of the invention, the point of contact of the first follower with the tip of the first valve lies on one side of the first reciprocal axis when the first valve is closed and at an equal distance on the other side of the first axis when the first valve is fully opened.

DETAILED DESCRIPTION OF THE PREFERRED EMBODIMENTS OF THE INVENTION

Figure 1:
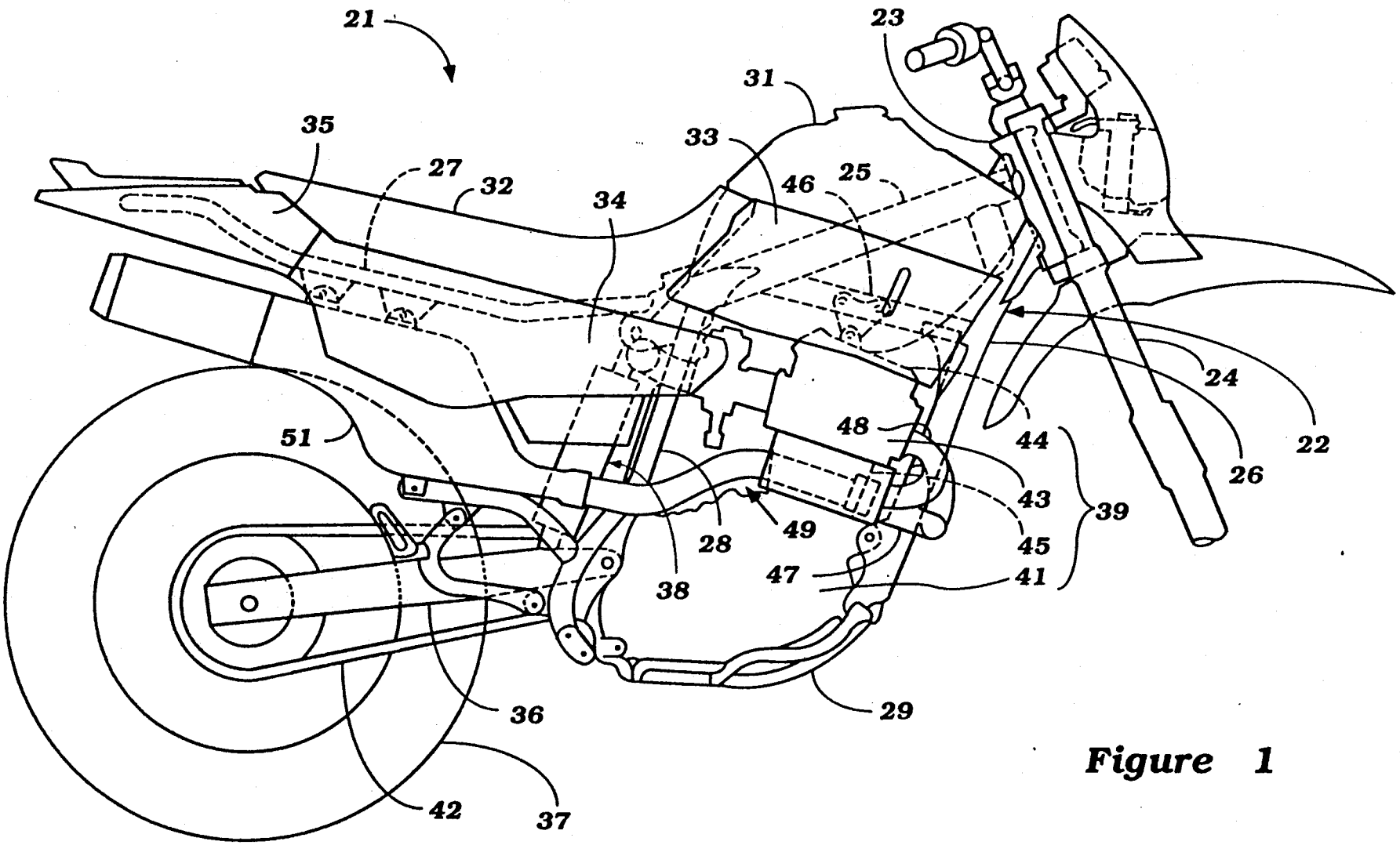
FIG. 1 is a partial side elevational view of a motorcycle powered by an internal combustion engine constructed in accordance with a first embodiment of the invention.

Referring first to FIG. 1, a motorcycle powered by an internal combustion engine constructed in accordance with an embodiment of the invention is identified generally by the reference numeral 21. The invention is described in conjunction with a motorcycle since it has particular utility in conjunction with such this type of vehicle. It is to be understood, however, that certain facets of the invention may be utilized in conjunction with internal combustion engines that power other types of vehicles or, for that matter, other applications for internal combustion engines.

The motorcycle 21 includes a welded frame assembly 22 having a head pipe 23 that journals a front fork 24 for steering movement. A front wheel (not shown) is journaled by the front fork 24 in a known manner.

The frame 22 further includes a main frame tube 25, a down tube 26, a seat rail 27 and a seat pillar 28. At the lower end of the frame, an underguard 29 spans the down tube 26 and the seat pillar 28.

A fuel tank 31 is positioned behind the head pipe 23 and ahead of a seat 32 that is carried by the seat rail 27. A small body assembly comprised of a side cover for the tank 31 and air scoop 33, a side covering for the lower portion of the seat 34 and a rear cover 35 are suitably affixed to the frame 22.

A trailing arm 36 suspends a rear wheel 37 from the frame assembly in a suitable manner, including a combined spring shock absorber 38 that lies generally on the longitudinal center plane of the motorcycle 21.

The rear wheel 37 is powered by an engine unit 39 which is comprised of a water cooled, single cylinder, four cycle, five valve, single overhead cam engine. A crankcase assembly 41 of the engine unit 39 contains- a change speed transmission which is driven by the engine crankshaft and which drives the rear wheel 37 through a chain 42. Although the details of the engine unit 39 and specifically the engine portion of it will be described by references to the remaining figures, the engine unit 39 includes a cylinder head 43, a cam cover 44 and a cylinder block 45 in addition to the crankcase 41. This engine unit is mounted in the frame 22 with the cylinder block 45 inclined slightly forward in a suitable manner by means including a support pipe 46 that is positioned beneath the main pipe 25 and which is joined to the main pipe 25 and the down tube 26.

As will become apparent, the engine unit 39 has a pair of forwardly facing exhaust ports from which a pair of exhaust pipes 47 and 48 extend into an exhaust system, indicated generally by the reference numeral 49 and which includes a side mounted muffler 51.

Figure 5:
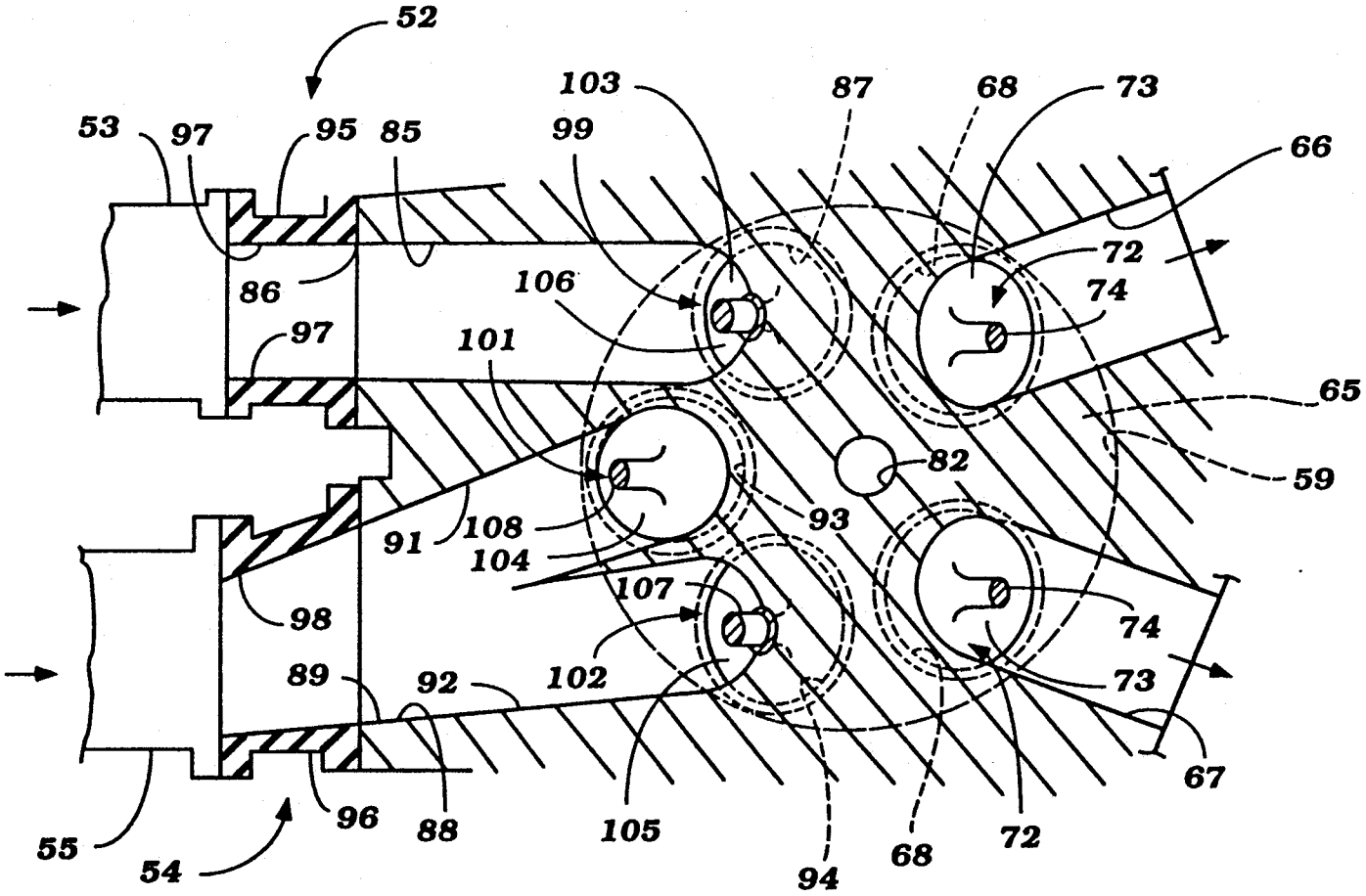
FIG. 5 is a cross sectional view of the cylinder head taken through the intake and exhaust ports to show the configuration of their passages.

The engine unit 39 also includes an induction system including an air box which is not shown in FIG. 1 that supplies air to a pair of carburetors which serve three rearwardly facing exhaust ports, as will be described by reference to the remaining figures. The induction system (FIG. 5) includes a primary induction system 52 including a primary carburetor 53 and a secondary system 54 including a secondary carburetor 55. Both carburetors 53 and 55 draw air from the aforenoted air box. The configuration of the components is such that the exhaust pipes 47 and 48 extends on opposite sides of the down tube 26 while the air box encircles the spring shock absorber unit 38 so as to provide a very compact assembly and yet one which will not interfere With the basic construction of the motorcycle or adversely affect the design of the engine.

Figure 3:
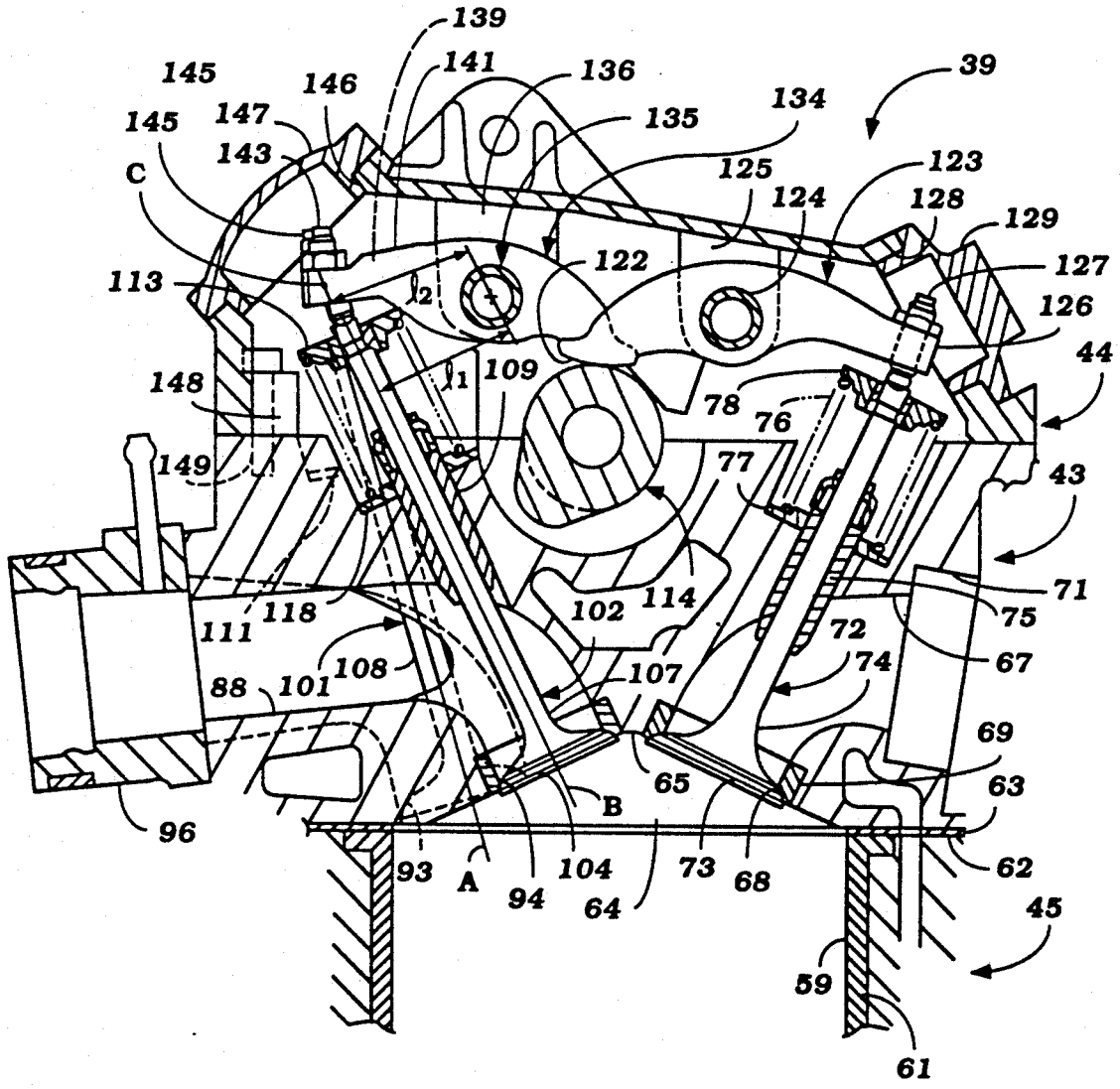
FIG. 3 is a cross sectional view of the complete cylinder head assembly and a portion of the associated cylinder block taken along the line 3—3 of FIG. 2.
Figure 4:
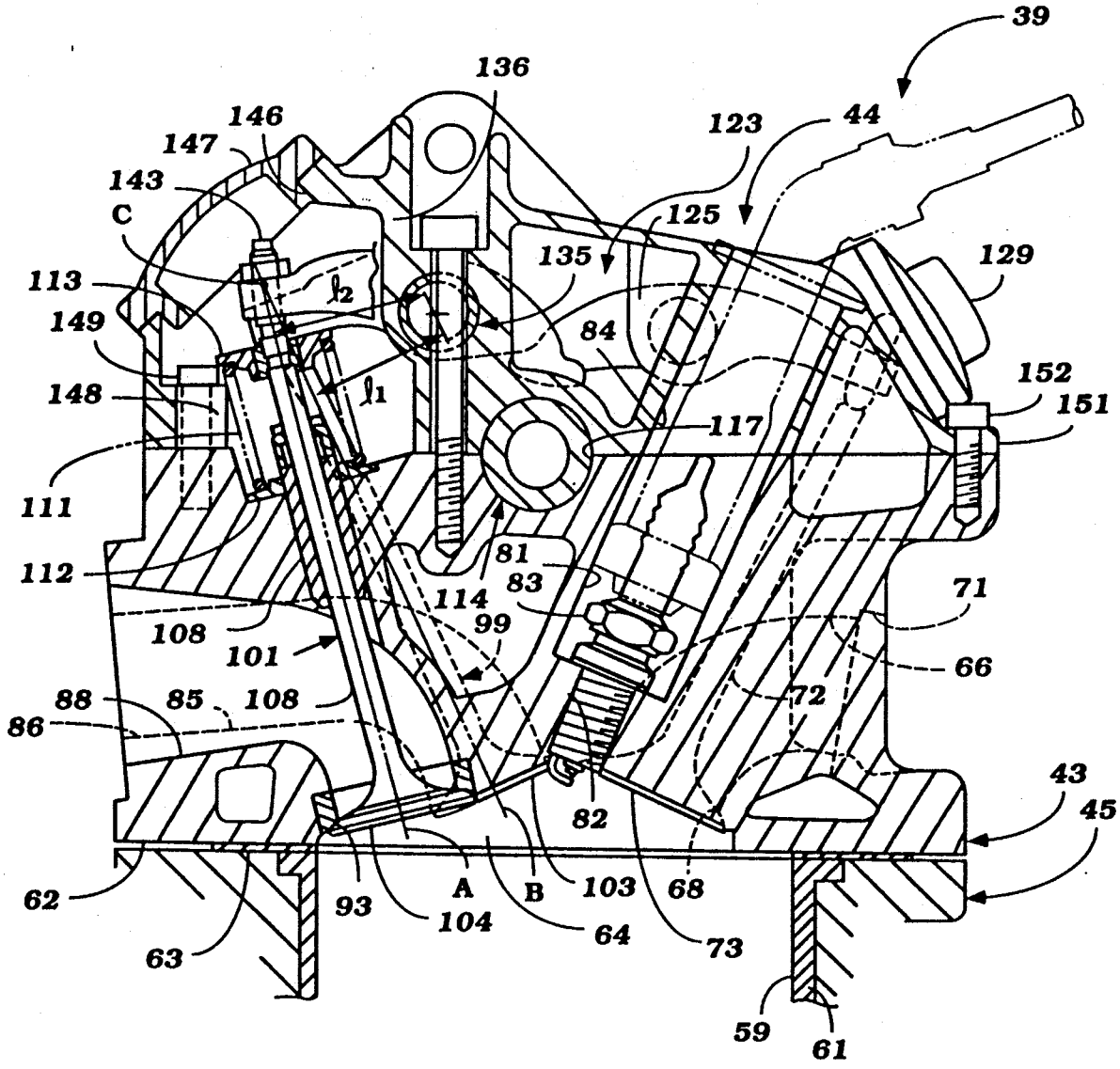
FIG. 4 is a cross sectional view taken along the line 4—4 of FIG. 2.

Referring now to FIGS. 3 and 4, it will be noted that the cylinder block 45 is formed with a cylinder bore 59 which is formed by a pressed or cast in liner 61. A piston (not shown) reciprocates within the cylinder bore 59 and drives the crankshaft (not shown) contained within the crankcase 41 in a well known manner. Since the invention deals primarily with the cylinder head 43 and valve train associated with it, those components of the engine which are considered to be conventional have not been illustrated and further description of them is not believed to be necessary to enable those skilled in the art to practice the invention.

The cylinder head 43 has a lower surface 62 that is sealingly engaged with a head gasket 63 so as to provide a seal with the cylinder block 45 around the cylinder bore 59. In addition, the cylinder head 43 is formed with a generally central recess 64 which recess is defined by a surface 65 surrounded by the lower cylinder head surface 62. This recess has a generally spherical configuration although it assumes a pent roof type of configuration as may be best seen in FIGS. 3 and 4.

Referring now primarily to FIGS. 2 through 5, the cylinder head 43 is formed with a pair of forwardly facing exhaust passages 66 and 67 each of which extends from the combustion chamber 66 through a valve seat 68 formed by a pressed in insert 69. These exhaust passages 66 and 67 terminate in forwardly facing exhaust ports 71 to which the respective exhaust pipes 47 and 48 are affixed in a suitable manner.

A pair of exhaust valves 72 each of which has a head portion 73 and a stem portion 74 are slideably supported for reciprocation within the cylinder head 43 by a respective pressed in valve guide 75. The exhaust valves 72 reciprocate within a common plane that is inclined at an acute angle to a plane containing the axis D (FIG. 2) of the cylinder bore 59. The axes of reciprocation also lie in planes that are parallel to each other and to the cylinder bore axis D. This facilitates operation of the valve although they may be slightly inclined if desired. The exhaust valves 72 are urged to their closed positions by means of respective coil compression springs 76 that engage wear plates 77 bearing against the cylinder head 43 and keeper retainer assemblies 78 affixed in a known manner to the upper ends of the exhaust valve stems 74. The exhaust valves 72 are opened in a manner which will be described.

It should be noted that the exhaust passages 66 and 67 are disposed at an angle to the plane containing the cylinder bore axis D and thus diverge from a plane perpendicular to this plane and also passing through the cylinder bore axis D. This permits the exhaust pipes 47 and 48 to clear the down tube 26 and also provides a better and less flow resistant path for the entire exhaust system.

A spark plug well 81 is formed in the cylinder head 43 between the exhaust passages 66 and 67 and terminates at a threaded opening 82 in which a spark plug 83 is received. The spark plug 83 is disposed so that its gap lies substantially on the cylinder bore axis D. A corresponding well 84 is formed in the cam cover 44 so as to facilitate insertion and removal of the spark plug 83 without removing the camcover 44. The, spark plug 83 is fired by a suitable ignition system.

A primary intake passage 85 extends through the opposite side of the cylinder head 43 from the exhaust side already described. The passage 85 extends from an intake port 86 formed in the side of the cylinder head 43 and terminates at a valve seat 87 formed by a pressed in insert. As may be best seen in FIG. 5, the primary intake passage 85 has a central axis that is generally perpendicular to the aforenoted plane containing the cylinder bore axis D and hence as a relatively short length from its intake port 86 to its valve seat 87. As a result, good, low and mid range performance and good response may be achieved. This passage 85 and its central axis is disposed at a distance from a plane which plane contains the axis of the cylinder bore D and is perpendicular to the aforenoted plane. The significance of this will be as described.

A siamese type secondary intake passage 88 extends from an intake port 89 formed in the intake side of the cylinder head 43 and branches into a pair of passages 91 and 92 each of which terminates at a respective valve seat comprised of a center valve seat 93 and a side valve seat 94. The center of the intake port 89 as extended by a spacer, to be described, is disposed at a distance from the place which distance is the same as the distance of the primary intake port 86. The carburetors 53 and 55 are affixed to these respective intake ports 86 and 89 through the intermediary of respective spacers 95 and 96 (FIG. 5) which have respective passage ways 97 and 98 that form extensions of the cylinder head intake passages 85 and 88. By utilizing the spacers it is possible to have this equal distance between the centers of the ports even though the actual port 89 is closer to the perpendicular plane than is the inlet of the passage 98 and its spacer. This construction permits the induction system to clear the shock absorber and spring assembly 38 and avoids interference between the carburetors 53 and 55.

A central effective line or bisector of the secondary intake passage 88 lies at an acute angle to the perpendicular plane while the portion 92 extends generally perpendicularly to the plane containing the axis of the cylinder bore D as aforenoted. As a result, the intake passages serving the side valve seats 87 and 94 are relatively short while the passage 91 is somewhat longer. This variation in length can be employed so as to achieve the desired flow pattern in the engine as will be described.

The carburetor 53 is sized and jetted and has a throttle valve (not shown) that functions to control both the low speed and mid range performance of the engine as well as the high speed performance. The throttle valve (not shown) of the carburetor 55 is operated in a staged sequence with the carburetor of the throttle valve 53 and the carburetor 55 may only have high speed circuits since this carburetor supplies the fuel air charge only to the engine under high speed operation. Either a staged linkage system or some form of load or speed responsive control (such as a vacuum responsive servo motor) can be employed for operating the throttle valve of the carburetor 55 in this staged sequence.

First, second and third poppet type intake valves 99, 101 and 102 have respective head portions 103, 104 and 105 which cooperate with the valve seats 87, 93 and 94 for controlling the flow through them. The intake valves 99 and 102 are side valves and have their respective stem portions 106 and 107 slidable supported in guides, to be described, for reciprocation about axes B which are in a common plane disposed at an acute angle $\theta_s$ (FIG. 6) to the plane containing the cylinder bore axis D which acute angle may be substantially the same as the acute angle of reciprocation of the exhaust valves 72. The center exhaust valve 101 has its stem portion 108 supported for reciprocation about an axis A which is disposed also at an acute angle $\theta_c$ (FIG. 6) to the aforenoted plane containing the cylinder bore axis D but which acute angle is lesser than the angle of reciprocation B of the valves 99 and 101. The angular disposition of the reciprocal axes A and B is such that these axes intersect a line C which is parallel to the plane containing the cylinder bore axis D but which is spaced from the tips of the individual intake valves 99, 101 and 102. As a result of this, the angular configuration of the side valves 99 and 102 relative to the center valve 101 is relatively small. This configuration permits the adjacent area between the intake valves to be relatively smooth and thus provide a smooth combustion chamber configuration that will avoid hot spots and still permit a generally spherical configuration.

The axes A and B of reciprocation of the intake valves 101 and 99 and 102 all lie in parallel planes which planes are parallel to the axis of the cylinder bore D. This permits ease of operation. However, if desired, these axes may be slightly skewed from parallel planes as is also possible with the exhaust valve 72, as previously noted.

The valve guides that slidable support the stems 106, 107 and 108 of the intake valves 99, 102 and 101 are each indicated by the reference numeral 109. Intake valve springs 111 engage bearing plates 112 that bear against the cylinder head 43 and keeper retainer assemblies 113 affixed to the upper ends of the respective valve stems for urging the intake valves 99, 101 and 102 to their closed positions. The intake valves 99, 101 and 102 are operated by means of rocker arm assemblies to be described.

Figure 2:
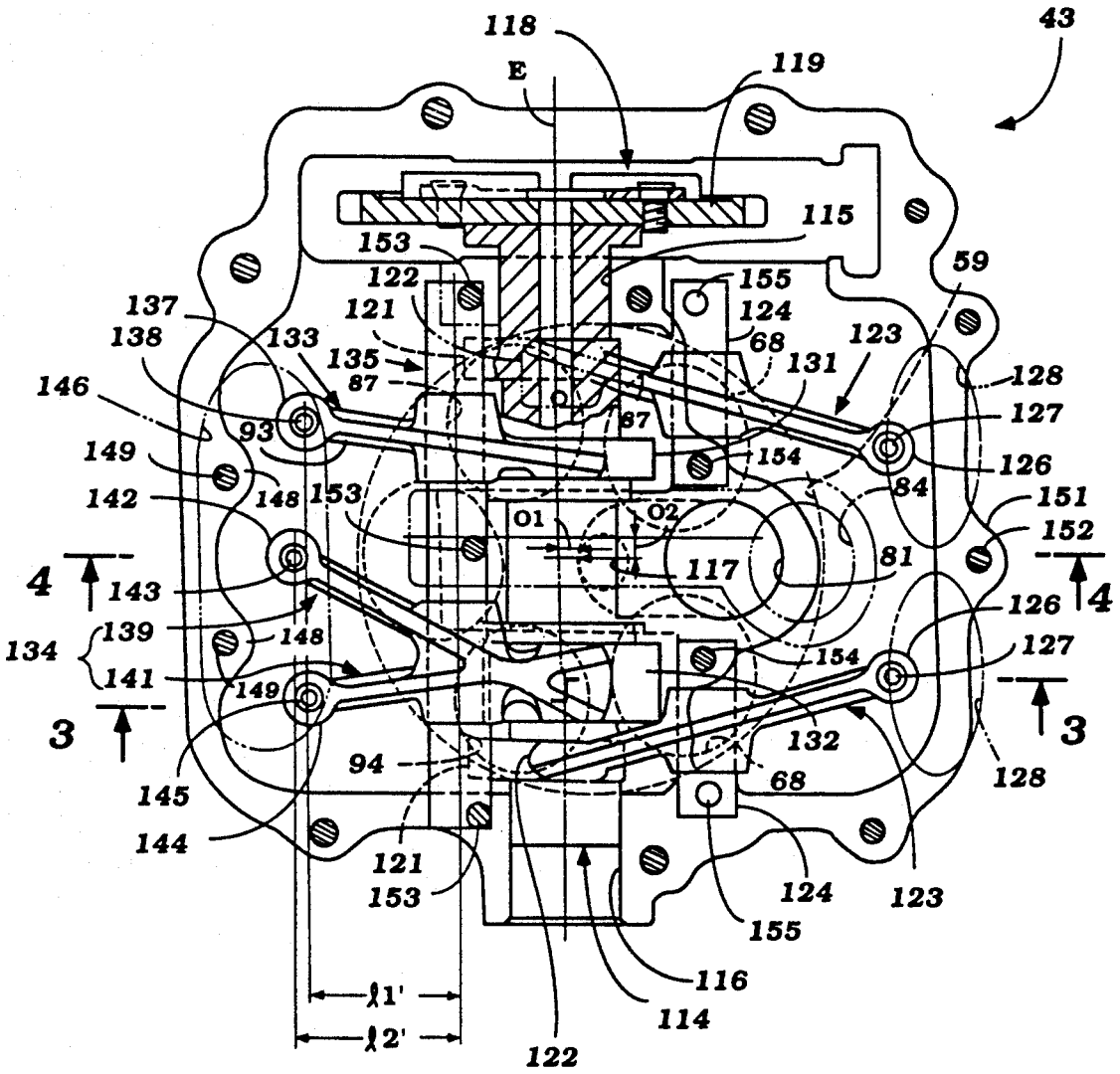
FIG. 2 is a top plan view, with portions broken away, showing the cylinder head assembly of the engine, with the cam cover removed and with portions shown in section.

The exhaust valves 72 and intake valves 99, 101 and 102 are all operated by means of a single overhead camshaft 114. The camshaft 114 is journaled, in a manner to be described, for rotation about an axis E which is offset to the intake side of the cylinder head from the cylinder bore axis D by a distance 01 (FIG. 2). The axis E is parallel to the plane aforementioned that contains the axis of the cylinder bore D. The camshaft 114 has end bearing surfaces that are journaled in bearing surfaces 115 and 116 formed by the cylinder head 43 and corresponding bearing surfaces formed by the cam cover 44. In addition, there is provided a central bearing surface on the camshaft 114 that is journaled by a bearing surface 117 formed in the cylinder head 43. A corresponding bearing surface is partially formed in the cam cover 44 and has its center offset a distance 02 from the cylinder bore axis D so as to provide clearance for other components of the cylinder head assembly to be described and specifically one of the rocker arms.

The camshaft 114 is driven from the engine crankshaft by means of a drive chain (not shown) and sprocket 118 that is affixed to one end of the camshaft. A decompression device 119 is associated with the sprocket 118 and serves to reduce the starting torque on the engine by lifting slightly one of the exhaust valves 72 during starting operation.

A pair of exhaust cam lobes 121 are formed at the outer ends of the camshaft 114 adjacent the bearings that engage the cylinder head bearing surfaces 115 and 116. These cam lobes 121 are engaged by follower surfaces 122 of exhaust rocker arms 123. These exhaust rocker arms 123 are journaled on stub rocker arm shafts 124 each of which is supported by a boss 125 formed on the inner surface of the cam cover 44.

The outer ends of the rocker arms 123 are provided with taped portions 126 that receive adjusting screws 127 for providing lash adjustment between the exhaust rocker arms 123 and the tips of the stems 74 of the exhaust valves 72 for clearance adjustment. Access openings 128 are provided in the cam cover 44 for facilitating valve adjustment without removal of the cam cover 44. These access openings 128 are normally closed by closure plugs 129 which are affixed in place in a suitable manner.

In addition to the exhaust cam lobes 121, the camshaft 114 is provided with a first intake cam lobe 131 and a second intake cam lobe 132 which lobes 131 and 132 are disposed on opposite sides of the central camshaft bearing surface which is journaled in the cylinder head bearing surface 117. The cam lobes 131 and 132 cooperate with respective rocker arms 133 and 134 for opening the intake valves 99, 101 and 102 respectively, in a manner to be described. The rocker arms 133 and 134 are both journaled on a single rocker arm shaft 135 that is journaled within the bearing surfaces formed by lugs 136 of the cam cover 44. These lugs 136 also form the bearing surfaces which cooperate with the cylinder head bearing surfaces 115, 116 and 117 for journaling the camshaft 114.

It has already been noted that the intake valves 99 and 102 reciprocate about respective reciprocal axes B and the intake valve 101 reciprocates about the axis A. As has been noted that the axes A and B intersect at a line C which is parallel to the aforenoted plane containing the cylinder bore axis D which point C is spaced from the tips of all of the intake valves. The center intake valve 101 has its tip spaced outwardly in a horizontal direction a greater distance 12' than the tips of the side intake valves 99 and 102 which valves lie at the distance 11' from the plane and also from the pivotally axes of the respective rocker arms 133 and 134. Also, it should be noted that the center intake valve 101 and specifically its axis B is at a perpendicular distance 11 from the rocker arm shaft 113 whereas the axes of reciprocation A of the other intake valves is a perpendicular distance 12 from this axis. This distance 11 is less than the distance 12. These differences in distance permit the smooth combustion chamber configuration previously noted and also permit a variation in the amount of lift for the two valves operated from the same cam lobe and same rocker arm, this being the cam lobe 132 and rocker arm 134 in this embodiment. As a result of the greater distance to the center intake valve 101 than the side intake valves 99 and 102 a greater amount of lift may be achieved for this valve than the other two. As a result, there can be generated more air flow through the center intake passage than the side intake passages. However, since the center intake passage is longer than that of the side intake passages due to the fact that the side intakes passages extend perpendicularly whereas the center intake passages disposed at an angle, it is also possible to obtain equal flows. However, the geometric relationships described permits the designer to achieve desired flow patterns within the combustion chamber under varying running conditions.

Although the tip of the center intake valves 101 is spaced different distances from the tips of the side intake valves 99 and 102 from the rocker arm axis E and also from the cylinder bore axis D, the tips of all of the stems of the intake valves 99, 101 and 102 lie at substantially the same vertical distance above the cylinder head sealing surface 62 and lie in a common plane with the pivot axis f of the rocker arms 133 and 134. This is done so as to reduce the overall height of the cylinder head assembly and of the engine, as will be described.

Rocker arm 133 has an enlarged taped portion 137 that receives an adjusting screw 138 that cooperates with the tip of the stem 106 of the intake valve 99 that is associated with the primary intake passage 85. As has been previously noted, the intake passage 85 is designed primarily to accommodate low and mid range performance and hence the cam lobe 131 may be configured to provide a lift characterize that is better tuned for low speed performance.

The rocker arm 134 has a pair of bifurcated arms 139 and 141 with the arm 139 having a threaded end 142 that receives an adjusting screw 143 that cooperates with the tip of the stem 108 of the center intake valve 101. The arm 141 has an enlarged taped portion 144 that receives an adjusting screw 145 that cooperates with the tip of the valve stem 107 of the intake valve 102 for clearance adjustment.

The cam cover 44 is provided with elongated opening 146 for accessing each of the adjusting screws 138, 143 and 145 so that the valve adjustment may be made without removing the cam cover. A removal closure plug 147 normally closes the opening 146 and is removed for servicing.

The cam lobe 132 associated with the rocker arm assembly 134 is configured so as to provide a greater degree of lift for both of the valves and also a longer event. This is because the rocker arm 134 is associated with the secondary or high speed intake passage 88 of the cylinder head 43. As has also be noted, due to the difference in length of the arms 139 and 141 the center intake valve 101 may have an even greater lift than the side intake valve 102. This configuration may be done so as to improve or generate swirl in the combustion chamber. Of course and as has been previously noted, those designers in the art may incorporate these features to provide different types of valve operation and different types of tuning.

The cam cover 44 is affixed to the cylinder head 43 by a plurality of fasteners, most of which are accessible from externally of the cam cover 44. However, the cam cover 44 is provided with an inwardly extending bosses 148 (FIGS. 2–4) into which threaded fasteners 149 are received for affixing the cam cover 44 to the cylinder head 43. These fasteners 149 are readily accessible through the surface opening 146 when the cover 147 is removed. A corresponding lug 151 is formed on the exterior of the cam cover 44 between the two exhaust rocker arms and is secured to the cylinder head 43 by a threaded fastener 152. Further threaded fasteners, indicated by the reference numerals 153 not only serve to hold the cam cover 44 to the cylinder head 43 but also serve to prevent rotation of the rocker arm shaft 135. Other threaded fasteners 154 serve to hold the cam cover 44 to the cylinder head 43 and also serve to prevent rotation of the rocker arm shafts 124. Further threaded fasteners 155 are fastened into the cam cover and serve only the purpose of preventing rotation of the rocker arm shafts 124.

It has been noted that the intake valves 99, 101 and 102 may have the same head diameter and the center intake valve 101 may have a greater lift than the others so as to compensate for the longer flow path to it and the greater flow resistance. The same effect can be provided by reducing the head diameters of center intake valve 101. This will permit the use of smaller diameter valve springs and so on for this valve and thus facilitate the freedom of design in the valve operating system.

Because two valves are operated by the rocker arm 134 while only a single valve is operated by the rocker arm 133, the stress on the rocker arm 134 is larger. However, because the cam shaft 134 is shifted to the intake side of the engine this stress can be reduced by reducing the total length of the rocker arms.

It has been noted that the tips of the stems of the intake valves 99, 101 and 102 all lie substantially on a common plane that contains the pivotal axis f of the rocker arms 133 and 134. However, this is done without substantially increasing the wear or loading on the valve actuating assembly and specifically the adjusting screws 143 and 145 and the tips of the stems of these valves. This relationship may be best understood by reference to FIGS. 6 through 8.

Figure 6:
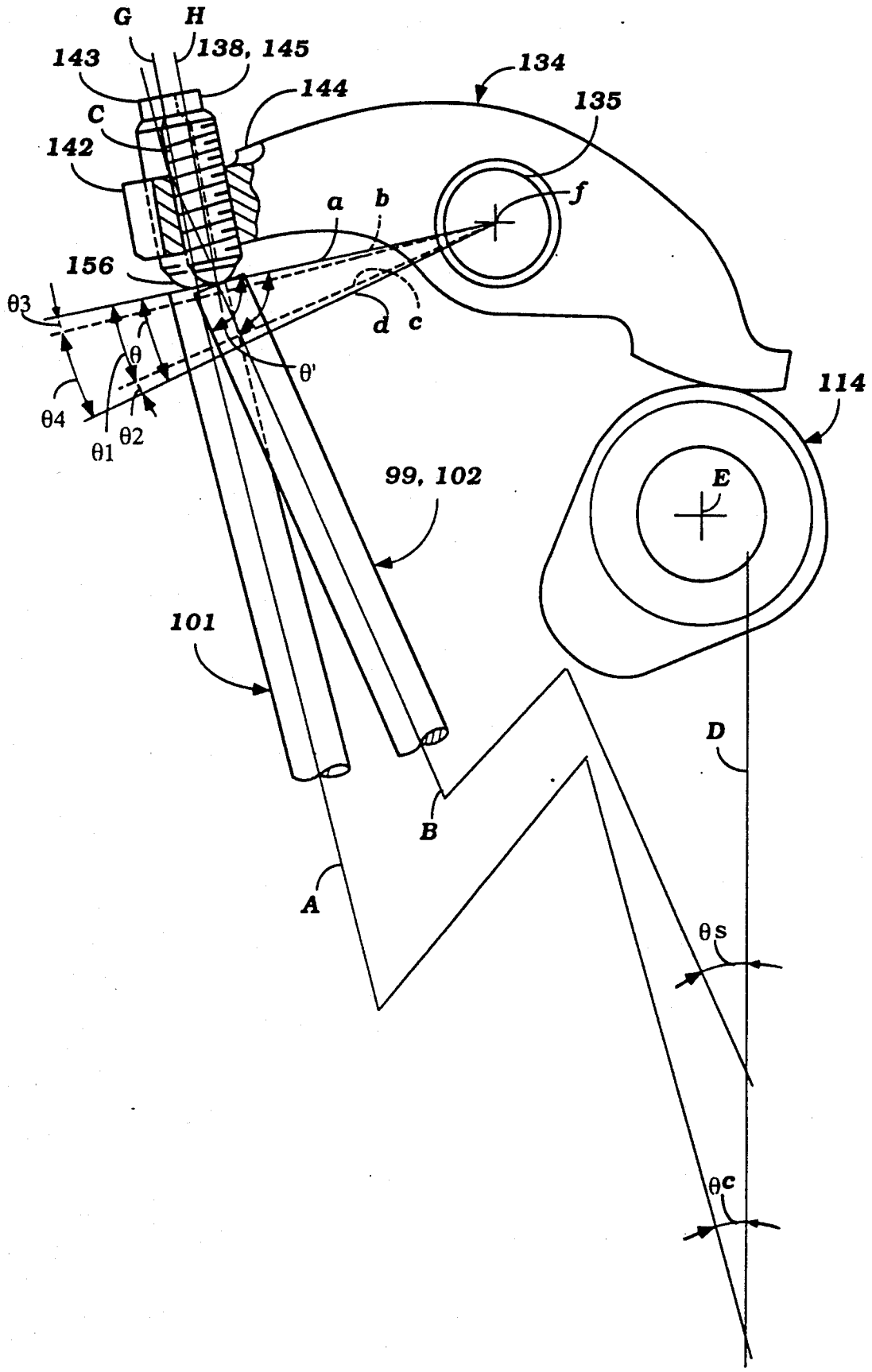
FIG. 6 is a side elevational view, with portions broken away, on a further enlarged scale in part similar to FIGS. 3 and 4 and shows the relationship between the rocker arms followers and intake valves.
Figure 7:
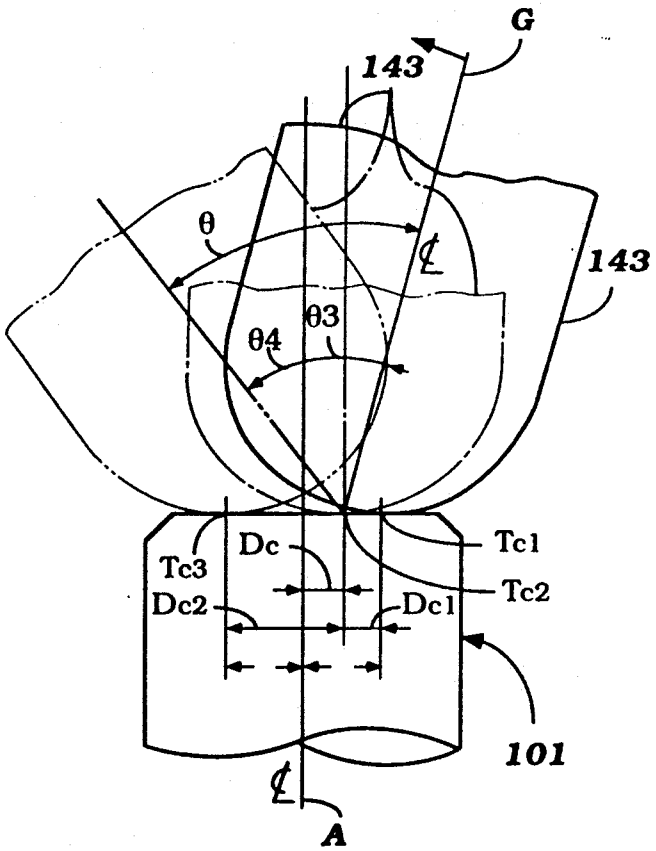
FIG. 7 is a still further enlarged view showing the relationship between the follower and tip of the center intake valve during its opening and closing operation.

Referring first to FIGS. 6 and 7, the relationship between the adjusting screw 143 and the center intake valve 101 may be best understood. It should be noted that the adjusting screw 143 has a spherical end portion 156 which when the intake valve 101 is in its fully closed position has its line of action G is disposed at an acute angle to the tip of the intake valve 101. The point of contact is indicated as $T_{c1}$ to one side of the reciprocal axis A and toward the rocker arm pivot axis f. A line "a" circumscribes the plane in which the rocker arm axis f and the tips of the stems of the valves 99, 101 and 102 lie when they are in their closed position.

As the rocker arm 134 pivots to open the intake valve 101, there will be a rolling action between the spherical end 143 and the tip of the stem of the valve 101 through an angle $\theta$ as shown in FIG. 7 which corresponds to the angular movement of the rocker arm 134 as the valve 101 is lifted. At an angle $\theta_3$, indicated by the broken line "b" the line of action G of the adjusting screw 143 will be disposed parallel to or in line with the reciprocal axis A and perpendicular to the plane b containing the tip of the valve stem and the rocker arm axis f. Continued movement then causes the valve 101 to continue opening as the rotation of the rocker arm 134 moves through the angle $\theta_4$. During this movement, the point of contact of the spherical end 143 with the stem 101 moves to the point $T_{c3}$ on the left hand or outer side of the reciprocal axis A as seen in FIG. 7.

It should be noted that the points $T_{c1}$ and $T_{c3}$ are disposed at distances which are equal distance from the reciprocal axis A and thus make more uniform the wear over the tip of the valve stem. When the angle is at a right angle, the point of contact is at the point $T_{c2}$ which is at a distance $D_0$ from the plane A and still on the right hand side. That is, when the valve 101 is moved from its closed position to the point where the adjusting screw axis G is parallel to the axis A, the tip will move the distance $D_{c1}$ which is still a distance $D_c$ displaced from the center axis A. Continued rotation causes the movement through the distance $D_{c2}$ to affect full opening of the valve. As a result of this operation, it is possible to still minimize wear but keep the overall height of the engine low.

Figure 8:
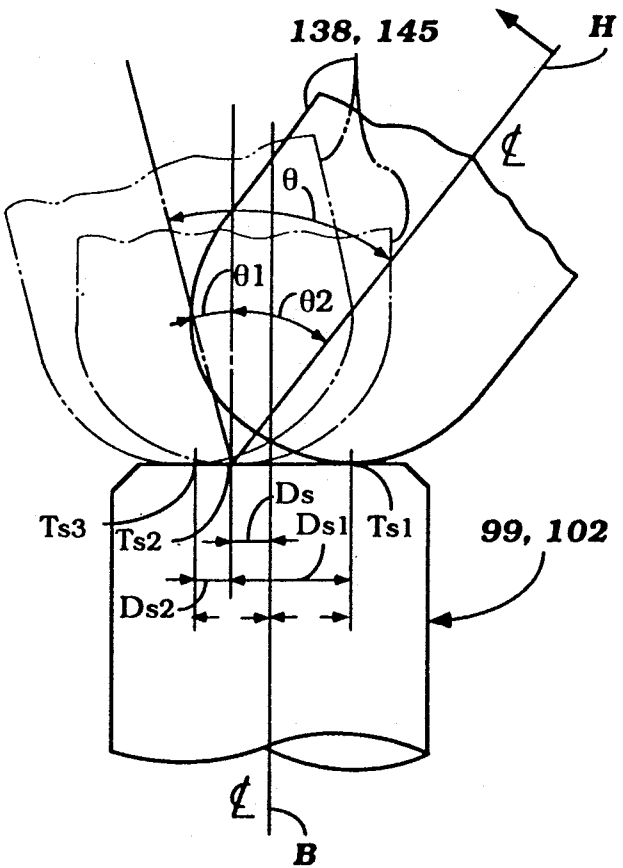
FIG. 8 is a further enlarged view, in part similar to FIG. 7, showing the relationship between the follower and the side intake valves.

A somewhat similar situation exists between the adjusting screw 138 and 145 and the tips of the valves 99 and 102 and shown in FIGS. 6 and 8. In this condition, the angular relationship between the line of action H of the adjusting screw 138 or 145 and the plane A is at an acute angle and the point of contact $T_{s1}$ is to the right side of the line of action B of the valve 99 and 102. On this side, the adjusting screw 138 and 145 rotates through an angle $\theta_1$ until the point of contact is at the point $T_{s3}$ at a distance $D_f$ to the left hand side of the line of action B wherein it is parallel to this axis. Continued opening movement causes the tip to move to the point $T_{s1}$ which is equal distance from the line of action B as the point $T_{s1}$. As a result, even though the right angle line of action is offset from the center of the tip of the stems of the valves 99 and 101 there will be uniform wear across the face of the valve stems.

In the illustrated embodiment, the valve 99 is operated by a single rocker arm 133 while the valves 101 and 102 are both operated by a single rocker arm 134. A reverse condition can be employed and also each valve can be operated by its own rocker arm. However, the described geometric relationship permits uniform wear and reduced loading on the valve actuating elements without increasing the height of the engine.

The invention has been described in conjunction with a single cylinder but it should be readily apparent to those skilled in the art how the invention can be practiced in conjunction with multiple cylinder engines. Also, various other changes and modifications may be made without departing from the spirit and scope of the invention, as defined by the appended claims.

We claim:

1. A valve system for a multi-valve internal combustion engine comprising a cylinder head assembly supporting first and second poppet valves for reciprocation between closed and opened positions about respective first and second reciprocal axes inclined at different acute angles to a plane containing an axis of an associated cylinder, said first acute angle being less than said second acute angle, rocker arm means for operating said valves, said rocker arm means being pivotal about a rocker arm axis that extends parallel to said plane, said rocker arm means having respective first and second follower portions engaged with tips of stems of said first and said second valves, respectively, said tips of said valves lying substantially in a common plane with said rocker arm axis when said valves are in their closed positions, the angle between a line passing between the point of contact of said first follower with said tip of said first valve and said rocker arm axis and said first reciprocal axis passing from an acute angle when said first valve is in its closed position to a right angle before said first valve is one half opened and to an obtuse angle when said first valve is fully opened.

2. A valve system as set forth in claim 1 wherein the rocker arms means comprises a single rocker arm having a pair of arms each carrying a respective one of the first and second followers.

3. A valve system as set forth in claim 1 wherein the rocker arm means comprises separate rocker arms.

4. A valve system as set forth in claim 1 further including a third valve supported for reciprocation by the cylinder head about a third reciprocal axis inclined at the same acute angle to the plane as the second reciprocal axis, the rocker arm means including third follower means for operating the third valve.

5. A valve system as set forth in claim 4 wherein the rocker arm means comprises a first rocker arm carrying the first and second follower means and a second rocker arm carrying the third follower means.

6. A valve system as set forth in claim 4 wherein each of the follower means is carried by a separate rocker arm.

7. A valve system as set forth in claim 1 wherein the angle between a line passing between the point of contact of the second follower with the tip of the second valve and the rocker arm axis and the second reciprocal axis passes from an acute angle when the second valve in its closed position to a right angle after the second valve is more than one half opened and to an obtuse angle when the second valve is fully opened.

8. A valve system as set forth in claim 7 wherein the rocker arms means comprises a single rocker arm having a pair of arms each carrying a respective one of the first and second followers.

9. A valve system as set forth in claim 7 wherein the rocker arm means comprises separate rocker arms.

10. A valve system as set forth in claim 7 further including a third valve supported for reciprocation by the cylinder head about a third reciprocal axis inclined at the same acute angle to the plane as the second reciprocal axis, the rocker arm means including third follower means for operating the third valve.

11. A valve system as set forth in claim 10 wherein the rocker arm means comprises a first rocker arm carrying the first and second follower means and a second rocker arm carrying the third follower means.

12. A valve system as set forth in claim 10 wherein each of the follower means is carried by a separate rocker arm.

13. A valve system as set forth in claim 1 wherein the point on contact of the first follower with the tip of the first valve lies on one side of the first reciprocal axis when the first valve is in its closed position and at an equal distance on the other side of the first reciprocal axis when the first valve is in a fully opened position.

14. A valve system as set forth in claim 13 wherein the point on contact of the second follower with the tip of the second valve lies on one side of the second reciprocal axis when the second valve is in its closed position and at an equal distance on the other side of the second reciprocal axis when the second valve is in its fully opened position.

15. A valve system as set forth in claim 14 wherein the rocker arm means comprises a single rocker arm having a pair of arms each carrying a respective one of the first and second followers.

16. A valve system as set forth in claim 14 wherein the rocker arm means comprises separate rocker arms.

17. A valve system as set forth in claim 14 further including a third valve supported for reciprocation by the cylinder head about a third reciprocal axis inclined at the same acute angle to the plane as the second reciprocal axis, the rocker arm means including third follower means for operating the third valve.

18. A valve system as set forth in claim 17 wherein the rocker arm means comprises a first rocker arm carrying the first and second follower means and a second rocker arm carrying the third follower means.

19. A valve system as set forth in claim 17 wherein each of the follower means is carried by a separate rocker arm.

20. A valve system for a multi-valve internal combustion engine comprising a cylinder head assembly supporting first and second poppet valves for reciprocation between closed and opened positions about respective first and second reciprocal axes inclined at different acute angles to a plane containing an axis of an associated cylinder, said first acute angle being less than said second acute angle, rocker arm means for operating said valves, said rocker arm means being pivotal about a rocker arm axis that extends parallel to said plane, said rocker arm means having respective first and second follower portions engaged with tips of stems of said first and said second valves, respectively, said tips of said valves lying substantially in a common plane with said rocker arm axis when said valves are in their closed positions, the point of contact of said first follower with said tip of said first valve lying on one side of said first reciprocal axis when said first valve is in its closed position and at an equal distance on the other side of said first reciprocal axis when said first valve is in its fully opened position.

21. A valve system as set forth in claim 20 wherein the point on contact of the second follower with the tip of the second valve lies on one side of the second reciprocal axis when the second valve is in its closed position and at an equal distance on the other side of the second reciprocal axis when the second valve is in its fully opened position.

22. A valve system as set forth in claim 20 wherein the rocker arm means comprises separate rocker arms.

23. A valve system as set forth in claim 20 further including a third valve supported for reciprocation by the cylinder head about a third reciprocal axis inclined at the same acute angle to the plane as the second reciprocal axis, the rocker arm means including third follower means for operating the third valve.

24. A valve system as set forth in claim 23 wherein the rocker arm means comprises a first rocker arm carrying the first and second follower means and a second rocker arm carrying the third follower means.

25. A valve system as set forth in claim 23 wherein each of the follower means is carried by a separate rocker arm.

26. A valve system as set forth in claim 20 wherein the point of contact of the second follower with the tip of the second valve lies on one side of said second reciprocal axis when said second valve is in its closed position and at an equal distance on the other side of said second reciprocal axis when said second valve is in it fully opened position.

27. A valve system as set forth in claim 26 wherein the rocker arm means comprises a single rocker arm having a pair of arms each carrying a respective one of the first and second followers.

28. A valve system as set forth in claim 26 wherein the rocker arm means comprises separate rocker arms.

29. A valve system as set forth in claim 26 further including a third valve supported for reciprocation by the cylinder head about a third reciprocal axis inclined at the same acute angle to the plane as the second reciprocal axis, the rocker arm means including third follower means for operating the third valve.

30. A valve system as set forth in claim 29 wherein the rocker arm means comprises a first rocker arm carrying the first and second follower means and a second rocker arm carrying the third follower means.

31. A valve system as set forth in claim 29 wherein each of the follower means is carried by a separate rocker arm.

* * * * *